United States Patent [19]

Lloyd

[11] Patent Number: 5,048,642

[45] Date of Patent: Sep. 17, 1991

[54] MAST STRUCTURE

[75] Inventor: Kurt M. Lloyd, Pewaukee, Wis.

[73] Assignee: Harnischfeger Engineers, Inc., Brookfield, Wis.

[21] Appl. No.: 411,294

[22] Filed: Sep. 22, 1989

[51] Int. Cl.[5] ..... B66B 7/02

[52] U.S. Cl. ..... 187/1 R; 187/95; 52/729; 52/731; 414/281

[58] Field of Search ..... 52/729, 731; 187/1 R, 187/9 R, 9 E, 20, 27, 95; 212/124; 414/246, 279, 281

[56] References Cited

U.S. PATENT DOCUMENTS

| | | | |
|---|---|---|---|
| 3,088,545 | 5/1963 | Meyer | 187/95 X |
| 4,109,805 | 8/1978 | Wagner | 414/281 X |
| 4,496,031 | 1/1985 | Allen et al. | 187/9 R |
| 4,529,066 | 7/1985 | Wieschel | 414/279 X |
| 4,614,253 | 9/1986 | Furukawa | 187/9 E |

FOREIGN PATENT DOCUMENTS 2261658 7/1973 Fed. Rep. of Germany .

*Primary Examiner*—Joseph E. Valenza
*Assistant Examiner*—Dean A. Reichard
*Attorney, Agent, or Firm*—Richard C. Ruppin

[57] ABSTRACT

A mast structure for a storage and retrieval machine is disclosed which includes first and second vertical members having lengths affixed to each other. The second vertical member includes a plate extending along the length of the second vertical member and spaced from the first vertical member in the direction of the path of travel of a base of the storage and retrieval machine. The first and second vertical members respectively have cross-section areas perpendicular to their lengths which are substantially equal to each other. The first and second vertical members together have a physical center and a centroidal axis both extending along the length of the members which may be adjacent to each other and preferably coincide with each other so that the two members together have a maximum section modulus in the direction of the path of movement of the base. The first vertical member has a tubular cross-section shape for guiding a carriage of the storage and retrieval machine along the length of the mast structure which is of a rectangular shape. The second vertical member is tapered so that the cross-section area of the second vertical member decreases in an upward direction to decrease the section modulus of the mast structure at its upper end where impact loading is less.

13 Claims, 4 Drawing Sheets

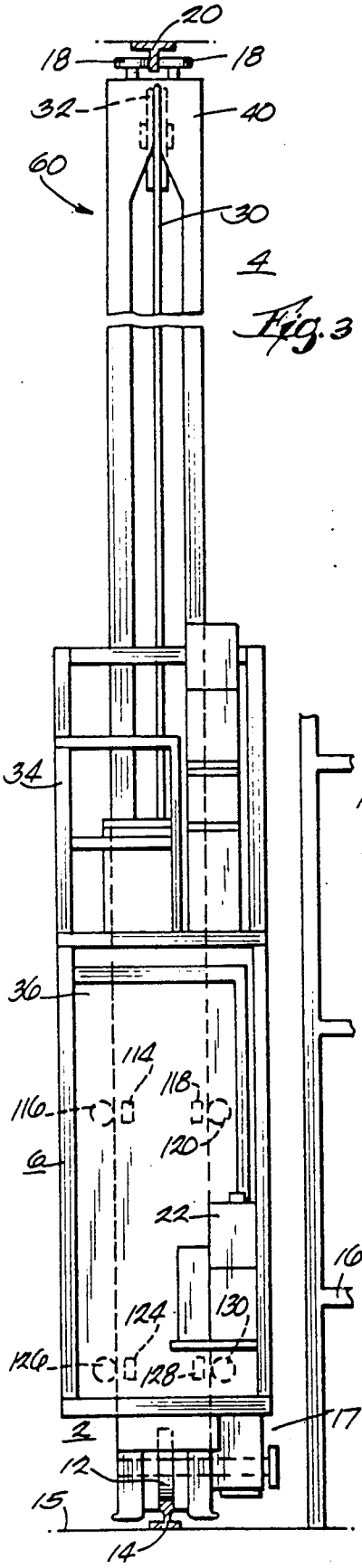
Fig. 3
Fig. 4
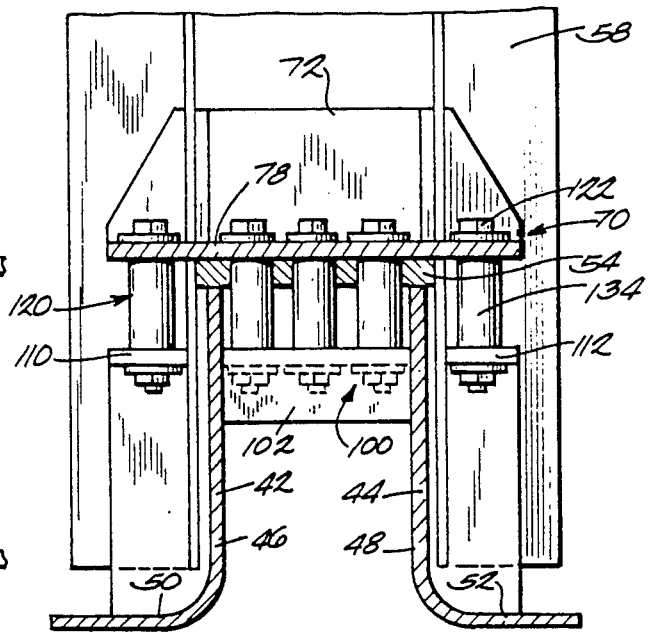
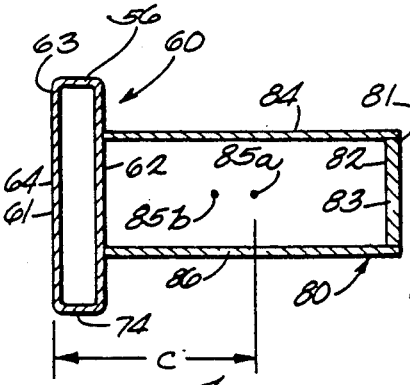
Fig. 7
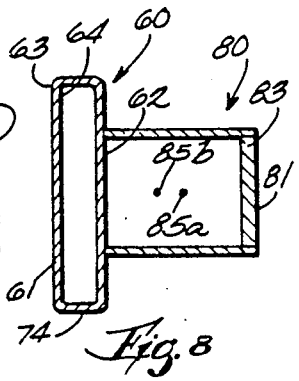
Fig. 8

Fig. 6
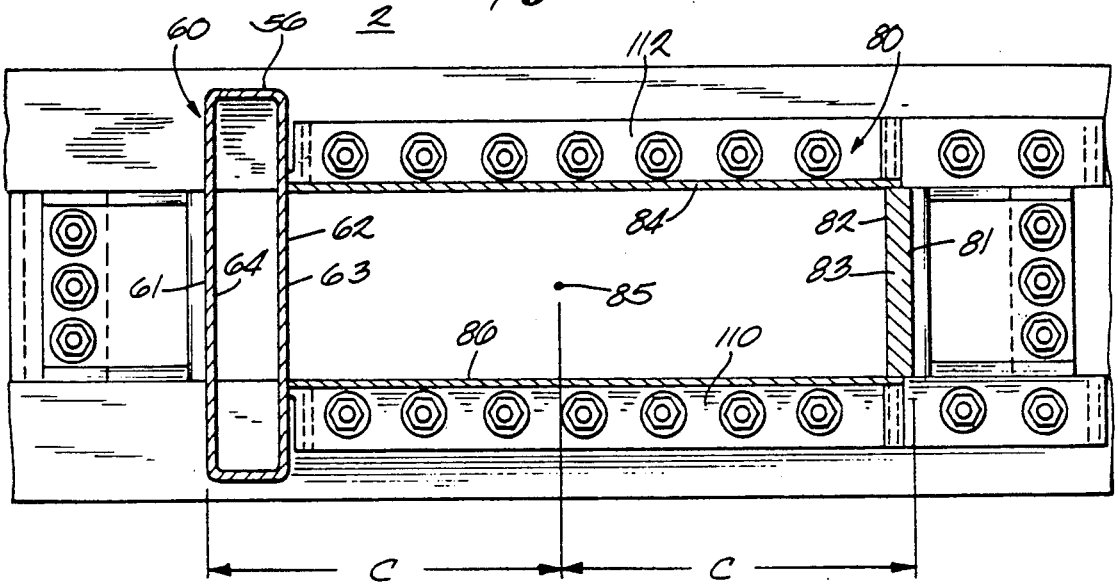
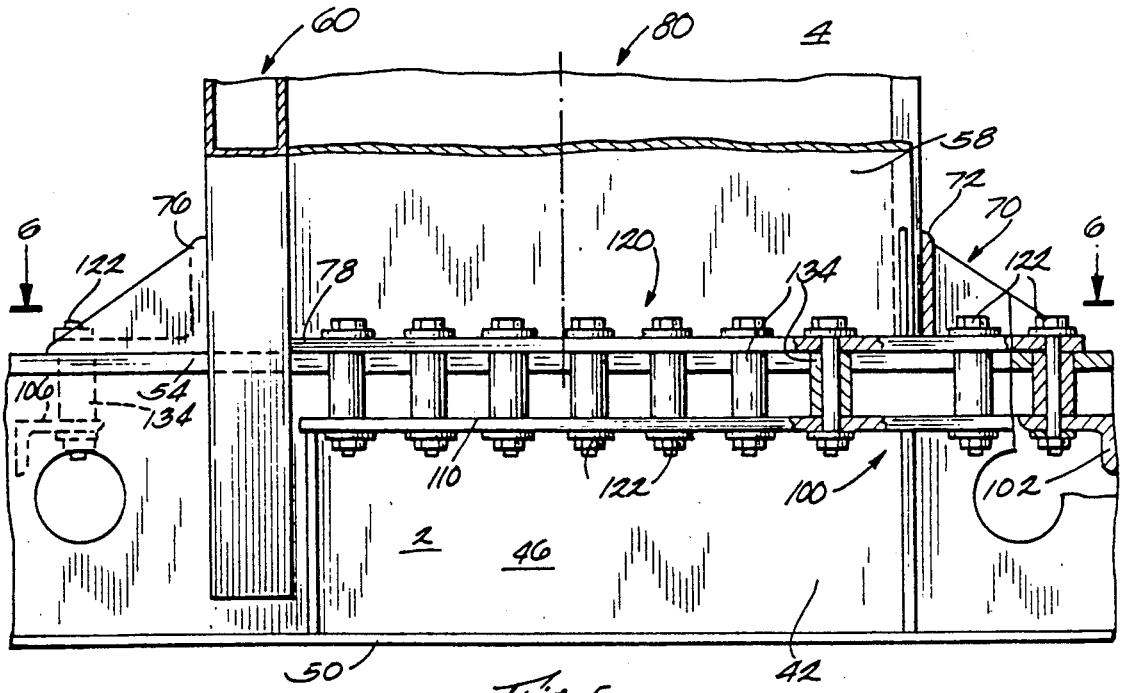
Fig. 5

MAST STRUCTURE

FIELD OF THE INVENTION

This invention relates to a high strength mast structure and, in particular, to a mast structure for a storage and retrieval machine having a carriage movable vertically on the mast structure.

BACKGROUND OF THE INVENTION

Masts of storage and retrieval machines are subject to impact loads if the machine runs out of control or objects strike the mast, or if the carriage movably mounted on the mast hits an object during either horizontal or vertical movement of the carriage. Thus, the structural design of the mast needs to provide sufficient strength to resist the high stresses encountered in the mast during an impact condition. The stresses in the mast are particularly high as a result of high inertial forces resulting from deceleration of the mast when the crane runs out of control and impacts a buffer. The resulting moment force increases in magnitude toward the lower end of the mast and therefore high structural strength of the mast at its lower end is particularly important. The stresses in the mast are contributed to by the mass of the mast itself and also by the mass of the carriage supported on the mast. The higher the position of the carriage on the mast at the time of impact to the mast, the greater the stresses will be on the mast.

In addition to supporting the carriage, the mast must incorporate guide means against which the wheels of the carriage roll as it moves vertically on the mast. Due to the weight of the carriage plus the load that it carries, the strength of the guide means must be fairly substantial and this adds further to the problems in designing a mast of adequate structural strength.

SUMMARY OF THE INVENTION

It is a general object of this invention to provide a mast structure for a storage and retrieval machine which provides the high structural strength necessary to withstand impact loading and support the weight of the carriage and objects carried by the carriage. It is a further object of the invention to provide a highly efficient mast structure which also incorporates a simple and high strength support and guide for a carriage movable vertically on the mast structure.

The invention is carried out by providing a mast structure for a storage and retrieval machine which includes first and second vertical members having lengths affixed to each other. The second vertical member includes a plate extending along the length of the second vertical member and spaced from the first vertical member in the direction of the path of travel of a base of the storage and retrieval machine. The first vertical member has a cross-section area perpendicular to its length and the plate of the second vertical member has a cross-section area perpendicular to the length of the second vertical member that is substantially equal to the cross-section area of the first vertical member. The first and second vertical members together have a physical center and a centroidal axis both extending along the lengths of the two members. The physical center and centroidal axis may be adjacent to each other and preferably coincide with each other so that the two members together have a maximum section modulus in the direction of the path of movement of the base.

The first vertical member of the mast structure may have a tubular cross-section shape for guiding the carriage means movable along the length of the mast structure by means of carriage rollers which engage the first vertical member. The tubular cross-section shape of the first vertical member should be suitable for providing carriage guidance and preferably is of a rectangular cross-section shape. The tubular cross-section shape is also preferred in that it provides greater impact loading and weight carrying strength.

The second vertical member may be tapered so that the cross-section area of the second vertical member decreases in an upward direction. The decreasing of the cross-section area of the second vertical member in an upward direction will correspondingly decrease the section modulus of the mast structure at its upper end where mast impact loading is less and thereby permit a lighter weight mast structure.

BRIEF DESCRIPTION OF THE DRAWINGS

Further objects and advantages will appear when taken in conjunction with the accompanying drawings, in which:

FIG. 3 is a rear end elevation view of the storage and retrieval machine shown in FIG. 1;

FIG. 4 is an enlarged cross-sectional view, taken along lines 4—4 of FIG. 2;

FIG. 5 is an enlarged side view of a portion of the mast and base of the storage and retrieval machine;

FIG. 6 is a cross-sectional plan view, taken along lines 6—6 of FIG. 5;

FIG. 7 is a cross-sectional plan view, with portions broken away, taken along lines 7—7 of FIG. 2; and FIG. 8 is a cross-sectional plan view, with portions broken away, taken along lines 8—8 of FIG. 2.

DETAILED DESCRIPTION OF THE INVENTION

Figure 1:
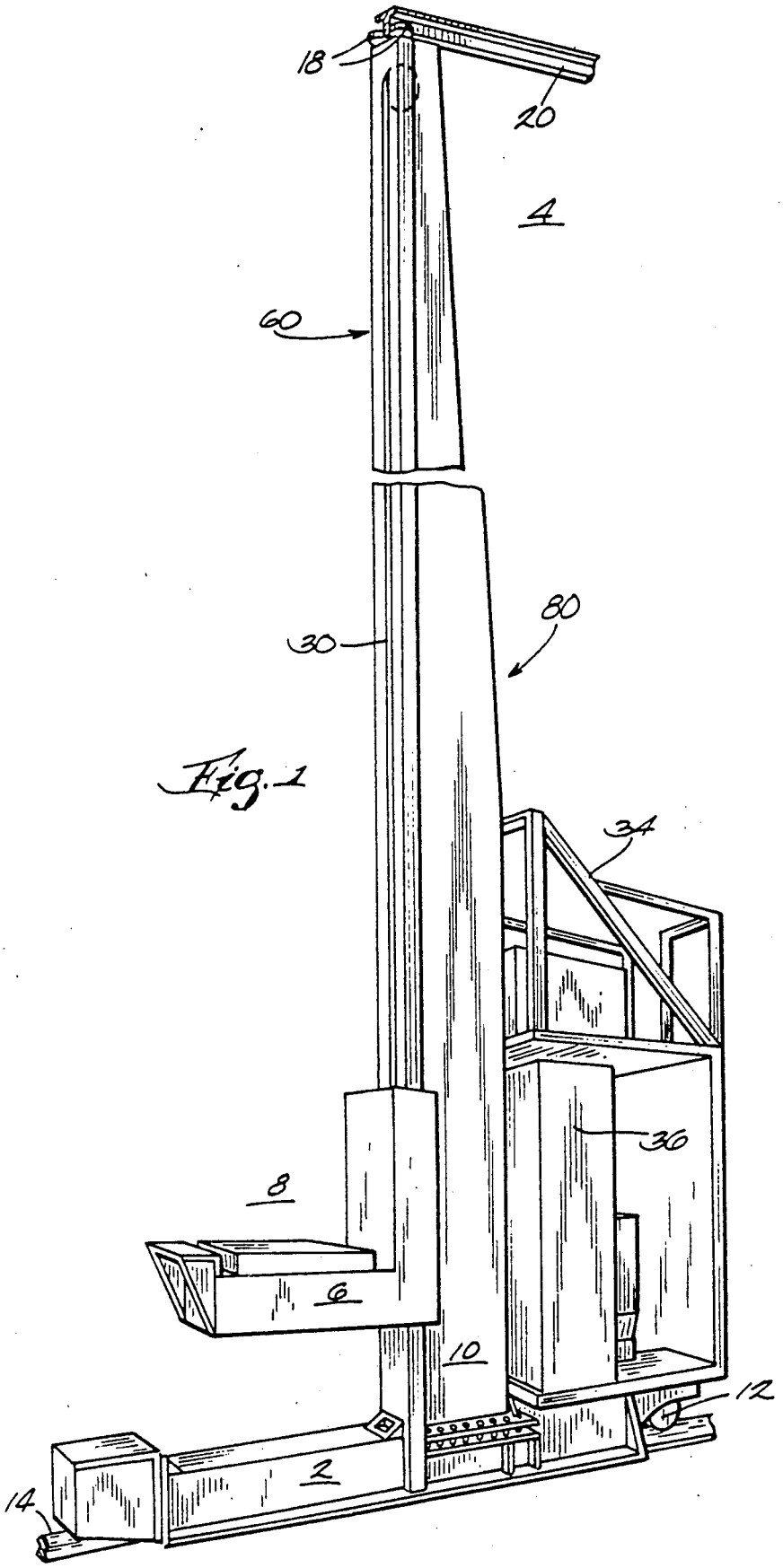
FIG. 1 is a perspective view of a storage and retrieval machine utilizing the mast structure according to the invention.
Figure 2:
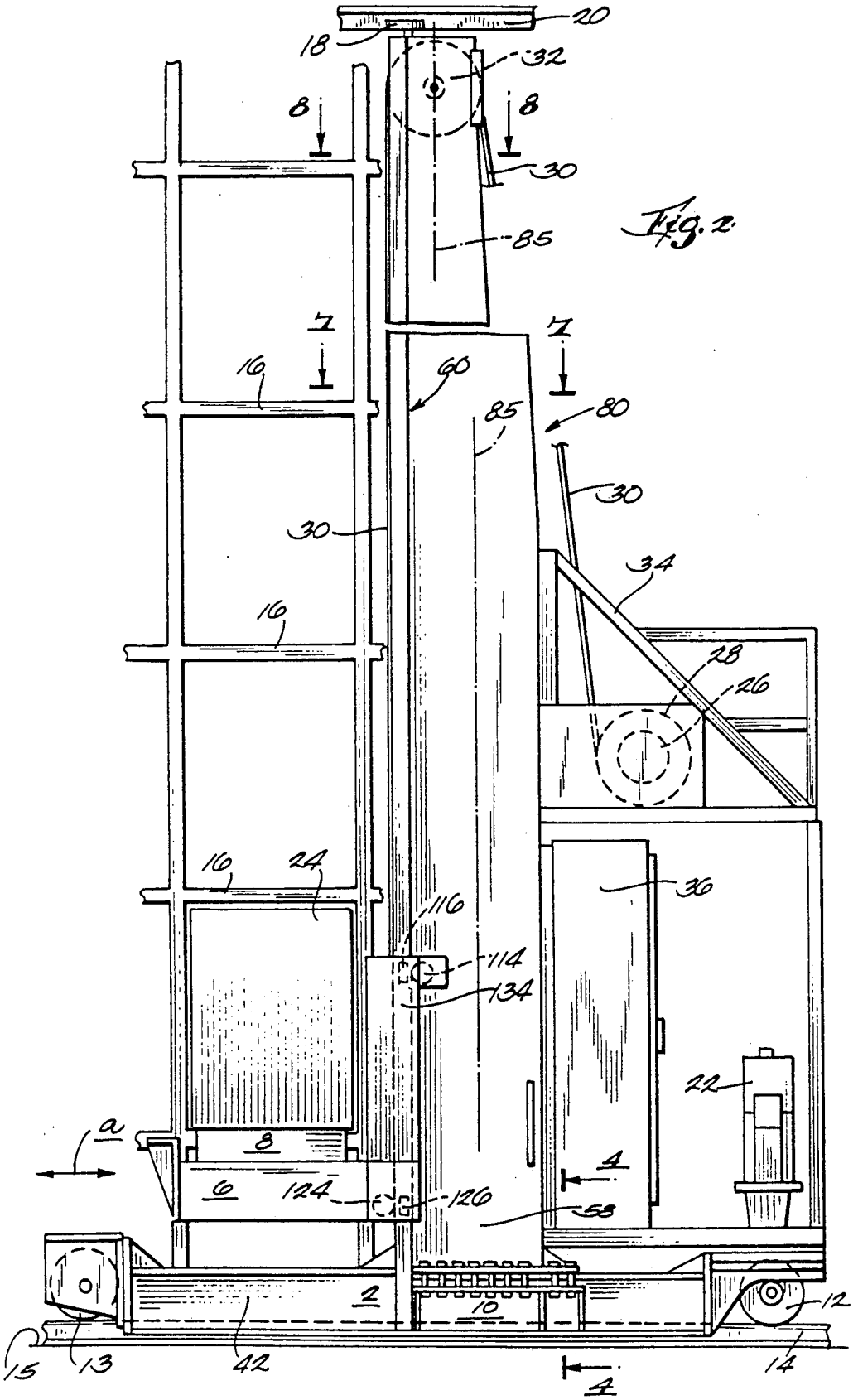
FIG. 2 is a side elevation view of the storage and retrieval machine shown in FIG. 1.

Referring generally to FIGS. 1–3 of the drawings, a storage and retrieval machine is shown having a base 2, a mast 4 mounted on and extending upwardly from the base 2, a mast connecting structure 10 for connecting the mast to the base, a carriage 6 movable along the length of the mast 4 to selected vertical positions, and a shuttle 8 mounted on the carriage 6. The mast 4 is comprised of an elongated tube member 60 and an elongated member 80. A front wheel 13 and a rear wheel 12 are mounted on the base 2 and roll along a rail 14 supported on a foundation 15 running in the directions indicated by arrow a in FIG. 2 through an aisle path 17 in a storage area such as a warehouse having stacked storage racks 16. Upper guide wheels 18 on the upper end 40 of the mast 4 engage an upper guide rail 20 to guide the storage and retrieval machine along the rail 14 and maintain the machine in an upright position. A motor 22 mounted on the base 2 drives the rear wheel 12 so that the storage and retrieval machine travels along the rail 14 to selected positions in the aisle path 17 adjacent to the stacked storage racks 16. At each aisle position of the machine the carriage 6 is driven in vertical directions to a selected one of the storage racks 16 where the shuttle 8 is driven substantially in horizontal directions into a storage rack to deliver or retrieve an object such as a box 24 shown in FIG. 2. The carriage 6 is driven by a motor 26 acting through a rope drum assembly 28, both mounted on a frame 34 affixed to the base 2 and the mast 4, and driving a rope 30 connected to the carriage 6 and wound around a sheave 32. The sheave 32 is rotatably supported on the tube member 60 so that the weight of the carriage 6 and any object 24 carried by it is directly supported by tube 60. A control 36 is also mounted on the base 2 for controlling the operation and movement to selected locations of the base 2, the carriage 6 and shuttle 8. Suitable means (not shown) are provided for supplying electrical power to the motors mounted on the base and carriage and control signals to the control 36.

The base 2 comprises two lengthwise parallel spaced apart L-shaped members 42 and 44 respectively having upper wall plates 46 and 48 and lower plates 50 and 52. The base 2 further comprises a top wall plate 54 which extends along a substantial middle portion of the length of the base 2 and is affixed to the members 42 and 44 by suitable means such as welding.

The mast connecting structure 10 includes an upper plate means 70, a lower plate means 100, and connecting means 120 connecting the plate means 70 and 100 together. The upper plate means 70 includes an angle iron 72, an angle iron 76, and a plate 78 all affixed by means such as welding to the lower end 58 of the mast 4. The angle iron 72, the angle iron 76 and the plate 78 each are positioned in engagement with the top wall 54 of the base 2 and together provide an anchoring section of the upper plate means 70 for the mast connecting structure 10. The lower plate means 100 comprises an angle iron 102 positioned between and affixed to the plates 46 and 48 of the base 2, and an angle iron 106 also positioned between and affixed to the plates 46 and 48, and connecting bars 110 and 112 respectively affixed to the outer sides of the plates 46 and 48.

The connecting means 120 includes a plurality of nut and bolt means 122 for connecting the upper and lower plate means 70 and 100 and thereby mounting the mast 4 on the base 2. A plurality of support tubes 134 are positioned coaxially on the bolt means 122. The bolt means 122 draws the angle irons 72, 76 and plate 78, against the support of the tubes 134, toward the angle irons 102, 106 and bars 110, 112 upon the tightening of the bolt means to connect the mast to the base.

The elongated tube 60 and the elongated member 80 of the mast 4 both have lengths extending from the lower end 58 of the mast 4 to the upper end 40 of the mast. The tube 60 and the member 80 are affixed to each other by suitable means, such as welding, and the affixation is preferably along the entire length of the tube and member. The tube 60 has a rectangular cross-section shape including opposite sidewalls 62 and 64 and opposite end sidewalls 56 and 74. The member 80 has a center wall 82 and side walls 84 and 86 affixed to the center wall by suitable means such as welding and also affixed by means such as welding to the tube 60. The lower end 58 of the mast is affixed to the mast connecting structure 10 and the mast is thereby mounted on the base as previously described.

With reference to FIGS. 2 and 6, the mast 4 has particularly high impact strength due to a high section modulus in the directions a of the aisle path 17 along which the base must move. A high section modulus is obtained by utilizing a relatively large cross-section area 63 of the tube 60 which is slightly larger than the cross-section area 83 of the wall 82 of the member 80 which is also relatively large. Although it is preferable that the cross-section area 63 be slightly larger than the cross-section area 83, if the two areas do not have this relationship but are nevertheless close in value, the mast 4 will still have a relatively high section modulus. The cross-section area 63 of the tube 60 can be slightly larger than or at least close in value to the area 83 of the wall 82 by using a tube cross-section shape which is suitable for acting both as a structural support wall for the mast 4 and as a guide and support track for the carriage 6. Consequently, it is not necessary to add track material for the carriage which would increase the cross-section area of the mast side supporting the carriage a very large amount. Use of a tube cross-section shape for the mast side supporting the carriage also provides the high strength, at a low material weight, needed to both support the carriage and withstand impact stresses.

With a cross-section area 63 that is slightly larger than the cross-section 83, the centroidal axis of the mast 4 will coincide with the physical center of the mast 4, the two together being identified by the number 85 in FIGS. 2, 5 and 6. If the area 63 does not slightly exceed the area 83, but the two areas are close in value, the centroidal axis 85*a* and physical center 85*b* will be separate but still adjacent to each other. In FIGS. 7 and 8 the centroidal axis 85*a* and physical center 85*b* are shown separate but adjacent to each other for area values in which the area 83 equals or slightly exceeds the area 63. If the area 63 slightly exceeds the area 83, the distance from the centroidal axis 85 to either of the outermost surfaces 61 and 81 of the respective walls 64 and 82 of the mast 4 in the direction of the aisle path 17 will be equal. In the equation $Z=I/c$, where z represents section modulus, I represents moment of inertia, and c is the longest of the distances from the centroidal axis to the surfaces 61 or 81, if these distances are equal, c has its minimum value. If the centroidal axis 85*a* is adjacent to the physical center 85*b*, the distance c will have a low value although it will not be minimal. The relatively large values of cross-section areas 63 and 83 will result in a correspondingly large moment of inertia value. Thus, at a low value of the distance c and a high value of moment of inertia, the section modulus of the mast 4 in the directions a of the aisle path 17 is maximized. The benefits of a high section modulus mast include the possibility of a lighter weight mast since the internal members such as side walls 84 and 86 may be thinner. Further, the number of welds typically needed to assemble the mast 4 is less than that required to assemble a mast including additional carriage guide tracks. For example, in assembling the member 80 and attaching the tube 60 and member 80 together, only four welds are required.

As can be seen in FIG. 2, the mast 4 is tapered in an upward direction to a smaller cross-sectional shape and the coinciding centroidal axis and physical center 85 follows the taper. On FIGS. 7 and 8, the smaller cross-sections of the mast 4 at higher positions on the mast due to the taper are illustrated. The separate but adjacent centroidal axis 85*a* and physical center 85*b* as shown in FIGS. 7 and 8 also follow the taper. As a consequence, the moment of inertia and therefore the section modulus of the mast 4 will decrease in an upward direction. The taper results in a lighter weight storage and retrieval machine and a saving of unnecessary materials. Since stress in the mast due to impact loading decreases in an upward direction, the section modulus may also be decreased in an upward direction by use of the taper.

The carriage 6 includes a frame 132 upon which the shuttle 8 is mounted and to which the rope 30 is connected for moving the carriage 6 vertically along the mast 4 in response to the operation of the rope drum assembly 28. The carriage is movably supported on the tube 60 of the mast 4 by means of a plurality of guide and support rollers 114, 116, and 118, 120 rotatably mounted on an upper section 134 of the frame 132, and rollers 124, 126 and 128, 130 respectively mounted on lower section 136 of the frame 132. The rollers 114 and 118 engage the wall 62 of the tube 60, the rollers 124 and 128, engage the wall 64 of the tube 60, the rollers 116 and 126, engage the end wall 74 of the tube 60, and the rollers 120 and 130 engage the end wall 56 of the tube 60. The carriage 6 is thus supported and guided directly on the tube 60 in a relatively simple fashion and no additional guide or track structure mounted on the mast is necessary. Moreover, the ability to guide the carriage on the tube 60 results in a mast structure which both directly guides the carriage 6 and provides a simple and efficient structural shape which has a minimum weight and a maximum strength for resisting impact loading.

It will be understood that the forgoing description of the present invention is for purposes of illustration only and that the invention is susceptible to a number of modifications or changes, none of which entail any departure from the spirit and scope of present invention as defined in the hereto appended claims.

What is claimed is:

1. In a storage and retrieval machine having a base movable along a path adjacent overhead storage locations, a mast mounted on the base at a lower end of the mast, and carriage means movable in vertical directions on the mast for carrying objects to and from the overhead locations, a mast structure comprising:

a first vertical member having a length and a cross-section area perpendicular to the length;

a second vertical member having a length parallel to the length of the first vertical member and being affixed to the first vertical member along the lengths of the two members, the second vertical member including a plate extending along the length of the second vertical member and spaced from the first vertical member in the direction of said path, the plate having a cross-section area perpendicular to the length of the second vertical member;

the first and second vertical members together having a physical center and a centroidal axis both extending along the lengths of the two members; and the cross-section area of the first vertical member is slightly greater than the cross-section area of the plate of the second vertical member such that the physical center and the centroidal axis coincide and the first and second vertical members have a maximum section modulus in the direction of said path.

2. The mast structure according to claim 1 wherein the first and second vertical members are both vertical load bearing members and are both mounted on the base for supporting vertical load on the mast.

3. The mast structure according to claim 2 wherein the cross-section shape is rectangular.

4. The mast structure according to claim 1 further comprising:

carriage means movable in vertical directions on the mast for carrying objects to and from said overhead locations, the carriage means including a plurality of rollers for supporting the carriage in its vertical movement; and the first vertical member is mounted on the base for supporting vertical load on the mast and has a tubular, rectangular cross-section shape including at least one pair of parallel opposite walls engaged by the plurality of rollers for guiding the rollers and thereby the carriage along the length of the first vertical member.

5. In a storage and retrieval machine having a base movable along a path adjacent overhead storage locations, a mast mounted on the base at a lower end of the mast, and carriage means movable in vertical directions on the mast for carrying objects to and from the overhead locations, a mast structure comprising:

a first vertical member having a length and a cross-section area perpendicular to the length;

a second vertical member having a length parallel to the length of the first vertical member and being affixed to the first vertical member along the lengths of the two members, the second vertical member including a plate extending along the length of the second vertical member and spaced from the first vertical member in the direction of said path, the plate having a cross-section area perpendicular to the length of the second vertical member;

the first and second members together have a physical center and a centroidal axis both extending along the lengths of the two members; and the cross-section area of the first vertical member and the plate of the second vertical member are close in value such that the centroidal axis is adjacent to the physical center.

6. The mast structure according to claim 5 further comprising:

carriage means movable in vertical directions on the mast for carrying objects to and from said overhead locations, the carriage means including a plurality of rollers for supporting the carriage in its vertical movement; and the first vertical member is mounted on the base for supporting vertical load on the mast and has a pair of parallel spaced apart opposite planar walls engaged by the plurality of rollers for guiding the rollers and thereby the carriage along the length of the first vertical member.

7. The mast structure according to claim 5 wherein the first and second vertical members are both vertical load bearing members and are both mounted on the base for supporting vertical load on the mast.

8. The mast structure according to claim 7 wherein a cross-section shape is rectangular.

9. In a storage and retrieval machine having a base movable along a path adjacent overhead storage locations and a mast mounted on the base at a lower end of the mast, the combination comprising:

carriage means movable in vertical directions on the mast for carrying objects to and from said overhead locations, the carriage means including a plurality of rollers for supporting the carriage in its vertical movement; and wherein the mast includes a vertical member having a length and mounted on the base for supporting vertical load on the mast, the vertical member having a tubular cross-section shape and a pair of parallel spaced apart opposite walls extending in the direction of said length and forming a part of the tubular cross-section, the opposite walls being engaged by the plurality of carriage rollers for guiding the rollers and thereby the carriage along the length during vertical movement.

10. In a storage and retrieval machine having a base movable along a path adjacent overhead storage locations, a mast mounted on the base at a lower end of the mast, and carriage means movable in vertical directions on the mast for carrying objects to and from the overhead locations, a mast structure comprising:

a first vertical member having a length and a tubular cross-section area perpendicular to the length;

a second vertical member having a length parallel to the length of the first vertical member and being affixed to the first vertical member along the lengths of the two members, the second vertical member having a cross-section area and a taper along the length of the second member toward the first member which decreases the cross-section area of the second member in a upward direction; and the first and second vertical members together have a centroidal axis extending along the lengths of the two members and following the taper toward the first member.

11. The mast structure according to claim 10 wherein:

the second vertical member includes a plate extending along the length of the second vertical member and spaced from the first vertical member in the direction of said path, the plate having a cross-section area perpendicular to the length of the second vertical member;

the first and second vertical members together have a physical center and a centroidal axis both extending along the lengths of the two members; and the cross-section areas of the first vertical member and of the plate of the second vertical member are close in value such that the centroidal axis is adjacent to the physical center.

12. The mast structure according to claim 10 wherein the centroidal axis of the first and second vertical members is parallel to the direction of said taper of the second vertical member.

13. The mast structure according to claim 10 wherein:

the second vertical member includes a pair of sidewalls having a width in the direction of said path; and only the sidewalls have said taper.

* * * * *